US007065999B2

(12) United States Patent
Fukuchi et al.

(10) Patent No.: US 7,065,999 B2
(45) Date of Patent: Jun. 27, 2006

(54) BENDING ROLL APPARATUS

(75) Inventors: Hiroshi Fukuchi, Futtsu (JP); Hiroyuki Mitake, Futtsu (JP); Shizuo Kohinata, Futtsu (JP); Kiyoshi Uda, Futtsu (JP); Tsutomu Haeno, Futtsu (JP); Hiroo Ishibashi, Kimitsu (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/485,925

(22) PCT Filed: Mar. 11, 2002

(86) PCT No.: PCT/JP02/02260

§ 371 (c)(1),
(2), (4) Date: Aug. 12, 2004

(87) PCT Pub. No.: WO03/013754

PCT Pub. Date: Feb. 20, 2003

(65) Prior Publication Data

US 2004/0261483 A1 Dec. 30, 2004

(30) Foreign Application Priority Data

Aug. 3, 2001 (JP) ..... 2001-235698
Feb. 1, 2002 (JP) ..... 2002-026164
Feb. 22, 2002 (JP) ..... 2002-047223

(51) Int. Cl.
*B21D 5/14* (2006.01)

(52) U.S. Cl. ..... 72/171; 72/166

(58) Field of Classification Search ..... 72/166, 72/170, 171, 173

See application file for complete search history.

(56) References Cited

U.S. PATENT DOCUMENTS 186,124 A * 1/1877 Goodell ..... 72/166
2,454,282 A * 11/1948 Johnson ..... 72/169
2,756,803 A * 7/1956 Faeber ..... 72/149
3,112,087 A * 11/1963 Fornataro ..... 72/155
3,899,911 A * 8/1975 Ogier et al. ..... 72/169
3,994,656 A * 11/1976 Van Ausdall ..... 425/391
4,063,442 A * 12/1977 Martin, Sr. ..... 72/166
5,425,258 A * 6/1995 Bogart ..... 72/169
5,450,739 A * 9/1995 Bogart et al. ..... 72/133
5,626,043 A * 5/1997 Bogart et al. ..... 72/133
6,631,631 B1 * 10/2003 Muller et al. ..... 72/169

* cited by examiner

*Primary Examiner*—Daniel C. Crane
(74) *Attorney, Agent, or Firm*—Baker Botts LLP

(57) ABSTRACT

This invention provides a bending roll apparatus capable of preventing barrel-like deformation of a pipe occurring during a roll bending work and of manufacturing a small diameter elongated pipe. In an apparatus for manufacturing a pipe by pushing rolls to a core roll, feeding a metal sheet to their contact portions and performing a bending work, the bending roll apparatus comprises a core roll formed of a metal and a plurality of push rolls having a surface portion thereof formed of an elastic material and disposed around the core roll. The invention further provides, in a bending roll apparatus, a core roll formed of a metal, a plurality of push rolls formed of a metal and disposed around the core roll, and holding the core roll when a metal sheet is bent, and a guide belt formed of an elastic material, interposed between the core roll and each of the push rolls, contacting on a core roll surface on a side opposite to an entry side of the metal sheet and driven in synchronism with the core roll.

11 Claims, 14 Drawing Sheets

BENDING ROLL APPARATUS

CROSS-REFERENCE TO RELATED APPLICATION(S)

This application is a national stage application of PCT Application No. PCT/JP02/02260 which was filed on Mar. 11, 2002, and published on Feb. 20, 2003 as International Publication No. WO 03/013754 (the "International Application"). This application claims priority from the International Application pursuant to 35 U.S.C. § 365. The present application also claims priority under 35 U.S.C. § 119 from Japanese Patent Application Nos. 2001-235698, 2002-026164 and 2002-047223, filed on Aug. 3, 2001, Feb. 1, 2002 and Feb. 22, 2002, respectively, the entire disclosures of which are incorporated herein by reference.

BACKGROUND OF THE INVENTION

1. Field of the Invention

The present invention relates to manufacture of pipes by roll bending a metal sheet, and more particularly to manufacture of elongated pipes having a small diameter.

2. Background Information

Manufacturing methods of pipes include a system that continuously manufactures pipes by electric welding and a system that manufactures them by roll bending with a use of a bending roll apparatus.

In the former, a manufacturing apparatus has a large scale, is expensive and is suitable for mass production. In the latter, in contrast, a manufacturing apparatus is economical but is not suitable for mass production.

To manufacture a thin elongated pipe, the conventional manufacturing system by electric welding can shape and weld a steel sheet having a thickness of at least 0.001 times a pipe diameter but this system is generally unsuitable for sheets having a smaller thickness than the above.

In the case of a system using the bending roll apparatus, on the other hand, shaping of a thin pipe is easy. When an elongated pipe having a relatively large length to diameter ratio is machined by using the bending roll apparatus, a core roll itself undergoes deflection in a longitudinal direction, so that deflection becomes great at a portion near the center of a roll and a roll push amount at this portion becomes small. Consequently, when a metal sheet is shaped into a pipe form, a gap develops at the center in the longitudinal direction of a product pipe as shown in FIG. 18 and the pipe becomes barrel-like. This tendency becomes remarkable when an elongated pipe is shaped. Therefore, when a pipe is produced by use of a steel material, it has been difficult, in many cases, to shape, by this method, an elongated pipe having a length that is at least about 10 times the pipe diameter.

To solve the problem of such barrel-like deformation, various attempts have been made by providing a crown to a core roll or by providing a backup roll to a push roll and intentionally causing deflection in a transverse direction so that the core roll and the push roll can keep a predetermined spacing, as typified by a bending roll apparatus described in Japanese Patent Publication No. 8-117869.

However, the prior art technologies for eliminating the barrel-like deformation by providing the crown to the core roll or by providing the backup roll to the push roll and intentionally causing deflection in the transverse direction so as to allow the core roll and push roll to maintain a predetermined gap cannot sufficiently compensate when an elongated pipe having a small diameter, as a work, is shaped because deflection of the core roll becomes excessively great. For example, an elongated pipe having a diameter of 50 mm and a length of 2,000 mm cannot be shaped by roll bending.

Japanese Patent Publication No. 9-70622 describes a roll bending method which can be used to prevent deflection of the core roll. When the metal sheet to be worked does not exist on the surface of the core roll on the side of a multi-diameter push roll having two kinds of diameters of a large arc portion and a small arc portion, the apparatus executes a push work on the large arc side. When the metal sheet exists on the roll surface, it executes the push work on the small arc side. This method applies a predetermined pressure to the core roll by such construction, and attempts to prevent the barrel-like deformation.

However, the technology described in this Japanese Patent Publication No. 9-70622 generally works a metal sheet having a length below the circumferential length of the core roll and cannot easily register the distal end of the metal sheet to be worked with a step portion of the push roll particularly when a small diameter elongated pipe of a high tensile strength metal sheet having a high elastic recovery ratio is manufactured. A manufacturing step of press-shaping the pipe by a shrink press after the metal sheet is shaped into the pipe and correcting the barrel-like deformation may be added.

Further, even when this shrink press step is employed, a shrink mold must be formed for each of the small diameter pipes and this invites an increase in the production cost.

SUMMARY OF THE INVENTION

The present invention is provided to address the problems described above, and is related to providing a bending roll apparatus capable of manufacturing a pipe having a small diameter and an elongated length.

According to one exemplary embodiment of the present invention, a bending roll apparatus is provided for manufacturing a pipe by pushing an elastic material member to a core roll, feeding a metal sheet to a contact portion between the core roll and the elastic material member and performing a bending work. The apparatus includes a core roll formed of a metal, and a clamping device for holding the core roll, which contacts and holds the core roll at a plurality of positions of a circumference of the core roll and clamping the metal sheet until the metal sheet to be bent is shaped into a pipe shape.

The clamping device can be a plurality of push rolls having a surface portion thereof formed of the elastic material member. A metal sheet guide belt driven in synchronism with the core roll can be added to the clamping device. The push rolls may be arranged in such a fashion as to face one another the core roll is held among them, and centers of the push rolls and a center of the core roll are arranged linearly.

In another exemplary embodiment of the present invention, the clamping device includes a plurality of push rolls and an elastic guide belt, and the elastic guide belt is wound on the plurality of push rolls and on the core roll. The apparatus can also include a bending belt formed of an elastic material, interposed between the core roll and each of the plurality of push rolls, passing on the surface of the core roll on a side opposite to an entry side of the metal sheet and driven in synchronism with the core roll, and a guide belt passing between the core roll and the bending belt and driven in synchronism with the core roll. The guide belt contacting with the core roll surface may have slits for reducing a bending radius in a longitudinal direction of the core roll.

According to still another exemplary embodiment of the present invention, the apparatus may include a metal sheet guide belt formed of an elastic material, interposed between the core roll and each of the plurality of push rolls, passing on a surface of the core roll on a side opposite to an entry side of the metal sheet and driven in synchronism with the core roll, a guide band disposed on the guide belt on a side of the push rolls and a groove for inserting the guide band formed in a surface of the push rolls. A winding belt can be provided having one of the ends thereof bonded and fixed to a surface of the core roll and the other end thereof fixed to a tension roll, a brake for imparting a predetermined tension to the winding belt winding in synchronism with the rotation of the core roll in a winding direction, a torque limiter operating at the time of winding and rewinding a metal sheet, and a winding/rewinding direction driving mechanism are provided to the tension roll. The plurality of push rolls may be arranged so as to oppose one another while the core roll is interposed, and a center of the core roll is so arranged as to be offset from a line connecting centers of the plurality of push rolls so arranged as to oppose one another.

A core roll may further be provided for changing a roll radius thereof so as to create a step corresponding to a thickness of the metal sheet to be bent at one position of an outer circumference of the core roll, and a metal sheet guide plate interposed between the plurality of push rolls and pushing a distal end of the metal sheet in a direction of the core roll surface.

All references referred herein are incorporated in their entireties by reference.

BRIEF DESCRIPTION OF THE DRAWINGS

FIG. 1(*b*) is side view of the bending roll of FIG. 1(*a*), in which two push rolls are disposed above and below while interposing a core roll;

FIG. 1(*c*) is side view of another exemplary embodiment of the bending roll according to the present invention, in which three push rolls are arranged while the core roll is interposed;

FIG. 1(*d*) is side view of still another exemplary embodiment of the bending roll according to the present invention, in which where four push rolls are arranged while interposing the core roll;

FIG. 1(*e*) is side view of yet another exemplary embodiment of the bending roll according to the present invention, in which a guide belt is disposed between two push rolls arranged above and below while the core roll is interposed.

DETAILED DESCRIPTION

Hereinafter, exemplary embodiments of a bending roll according to the present invention are explained below with reference to the drawings.

The bending roll of the embodiment shown in FIGS. 1(*a*) to 4 includes a core roll 1 that feeds a metal sheet and operates as a center of a bending work, two push rolls 2A and 2B or 2C and 2D arranged above and below the core roll 1 and a frame 3 that supports these rolls. The core roll is a core roll that is formed of a suitable metal such as iron and is ordinarily used, and is rotatably supported by the frame 3.

Figure 2:
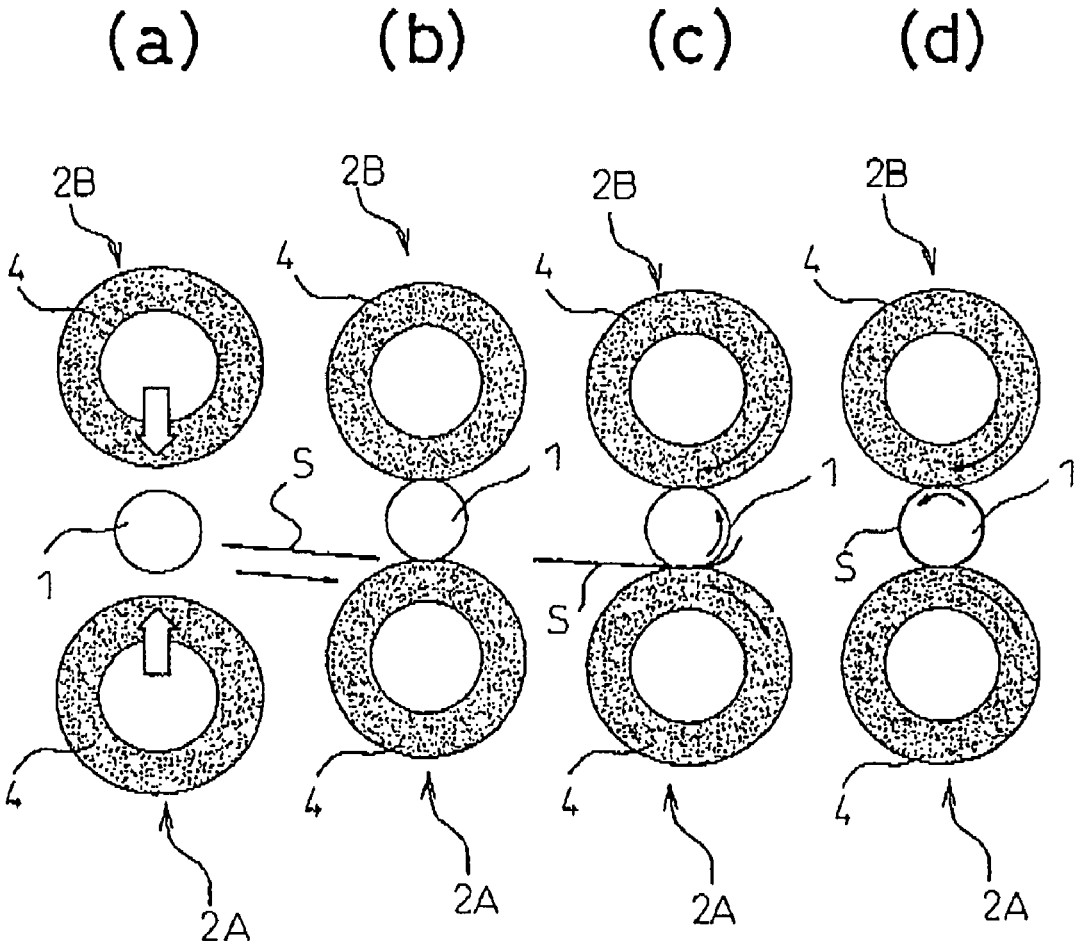
FIGS. 2(*a*)–(*d*) are exemplary illustrations of operating conditions of the bending roll in FIG. 1(*b*).

The push roll 2 has a flexible member 4 on a surface portion of an ordinary push roll 1 as shown in FIG. 2.

The push rolls 2 are arranged linearly above and below the core roll 1 in such a fashion as to interpose the core roll 1. The elastic material member 4 provided to the push roll 2 uses a rubber material, for example, and its thickness is generally from about 20 to about 100 mm so as to provide sufficient elastic deformation capacity.

Figure 1:
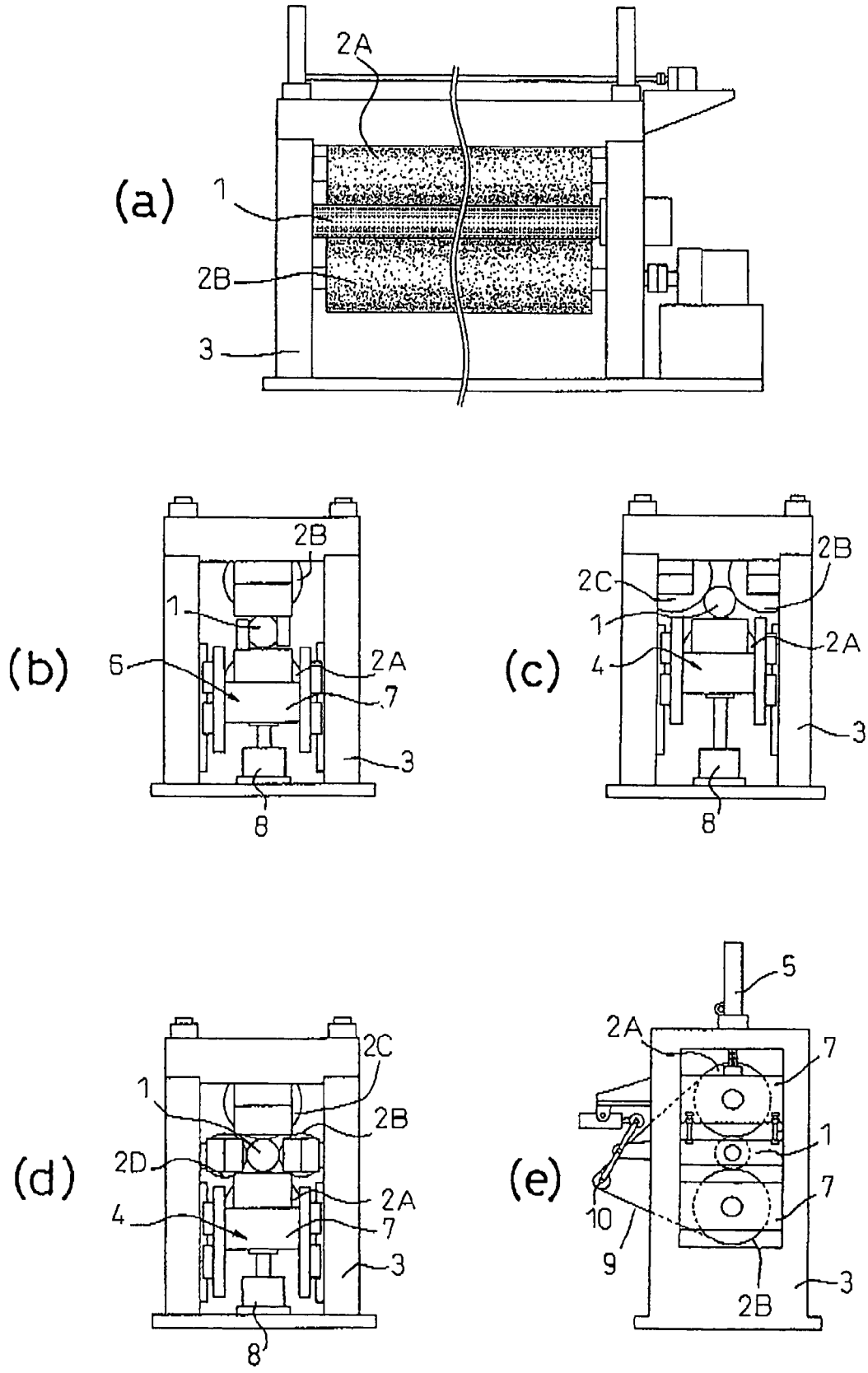
FIG. 1(*a*) is front view of an exemplary embodiment of a bending roll having a plurality of push rolls according to the present invention.

As shown in FIG. 1(*e*), the bending roll apparatus comprises the core roll 1 for feeding the metal sheet and operating as the center of the bending work, a plurality of push rolls 2A and 2B disposed above or below, or on the right and left of, the core roll 1, and a guide belt 9 of an elastic material interposed between the core roll 1 and each of the upper and lower push rolls 2 and capable of moving in synchronism with the push rolls 2.

The push rolls 2 can be moved up and down by a roll elevation device 5 installed separately, can be pushed to the core roll 1 and can also be rotated by a suitable driving source such as a motor.

As shown in FIG. 1(*b*), for example, guides of a roll push device 6 disposed at both ends of a support 7 for supporting both ends of the push roll 2 can slide on rails disposed on the side surfaces of support pole portions of the frame 3. A cylinder 8 using a suitable driving power source such as oil pressure, and installed at a lower part of the support 7, can push the push rolls to the core roll. Incidentally, as shown in FIG. 1(*c*), the roll push device 5 may be arranged at an upper position, and may use a similar roll push device or a push device using an electric jack cylinder each not being specifically shown in the drawing.

Manufacture of a pipe in the exemplary embodiment of the bending roll described above, where the push rolls are arranged linearly above and below the core roll while the core roll is interposed, will be described.

From a standby state from the core roll 1, the first and second push rolls 2A and 2B move in a direction indicated by arrows in FIG. 2(*a*) and each push roll 2 moves in such a fashion as to push the core roll 1 (see FIG. 2(*b*)). From this state, a metal sheet S as a pipe material travels from between the core roll 1 and the first push roll 2A and is subjected to the roll bending work by the core roll and the push roll 2A (see FIG. 2(*c*)). Next, when the distal end of the metal sheet S reaches the push roll 2B, the roll bending work is again applied by the core roll 1 and the push roll 2B, and the roll bending work is finished when the sheet S is wrapped substantially round the circumference of the core roll 1 (see FIG. 2(*d*)).

The rotation of each roll is thereafter stopped and the push rolls 2A and 2B are moved back. The metal sheet shaped into the pipe shape is taken out from the core roll 1 and is passed through a welding step, not shown, to weld the end portions and to complete a product.

Figure 3:
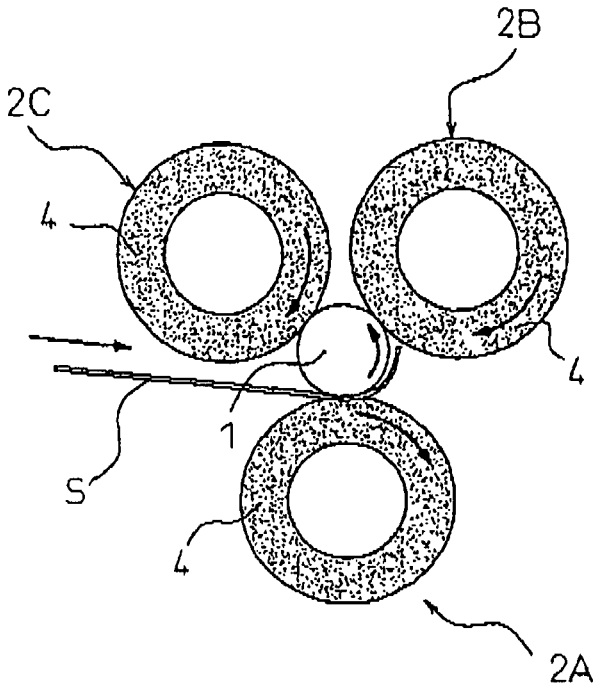
FIG. 3 is an exemplary embodiment of a bending roll having three bending rolls according to the present invention.
Figure 4:
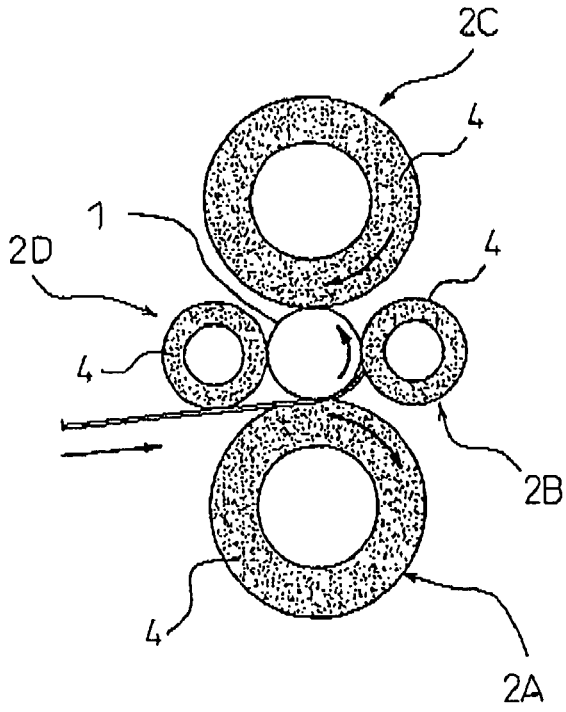
FIG. 4 is an exemplary embodiment of a bending roll having three push rolls according to the present invention.

FIG. 3 shows an example where three push rolls 2 are disposed and FIG. 4 shows an example where four push rolls 2 are disposed. Unlike the first embodiment, when the distal end of the metal sheet S subjected to the roll bending work by the core roll 1 and the first push roll 2A reaches relatively immediately the next push roll 2B, the metal sheet S reaches the next push roll while the distance of the metal sheet S from the core roll 1 is still small. Consequently, the distal end portion of the metal sheet S is not bent or broken, and the roll bending work can be carried out smoothly.

Incidentally, the greater the number of push rolls 2, the better becomes the finish. When five or more push rolls 2 are used, however, the fitting structure of the push rolls becomes complicated and the expens of the rolls is not economical. Therefore, from the aspect of the problem of cost, the number of push rolls is preferably 4 or below.

In the bending roll according to the present invention, it can be effective to fit a permanent magnet or a solenoid coil to the core roll in order to magnetically attract the distal end portion of the metal sheet to the core roll and to prevent the distal end portion from being lifted up by spring-back of the metal sheet.

Next, an exemplary guide belt shall be described. As shown in FIGS. 1(*e*) and 5(*a*)–(*e*), the guide belt 9 is driven for rotation in synchronism with the rotating speed of the core roll 1 at contact portions between the core roll 1 as the center and the push rolls disposed above and below the core roll 1. The guide belt 9 is wound in a path from the push roll 2A to the core roll 1 to the push roll 2B to the tension roll 10 and to the push roll 2A. The surface of the core roll 1 is released for leading the metal sheet S on the side of the core roll 1 on which the guide belt 9 is not wound.

The guide belt 9 is wound in this way over about a half circumference of the core roll 1 and prevents spring-back of the metal sheet S. The tension roll 10 is formed of a metal, for example, in the same way as the core roll and its position can be changed by suitable means such as a cylinder so as to impart and release a tension to and from the guide belt 9. The guide belt 9 is produced by coating a surface of a fiber substrate such as polyester or nylon with a urethane rubber film-coated fiber cloth to achieve elastic compatibility, or by further stacking a rubber material on the former to provide a thick elastic belt.

In this manner, the bending work by use of the guide belt will be explained. A deformation amount of the guide belt relative to the rolling reduction force for causing deformation of the metal sheet is given by the following formula irrespective of the belt thickness and the material. Incidentally, the following formula can also be applied to the case where a flexible roll is used for the push roll.

$$F=8E_o(bD^{1/2}\delta^{3/2})/3t \quad (1)$$

where F: load [Kg]

D: roll diameter [Mm]

t: belt thickness [mm]

$E_o$: Young's modulus of belt material [Kg/mm$^3$]

δ: flatness ratio [mm]

A nip width W [mm] of the guide belt 8 is expressed by the following formula.

$$W=2\{(D/2)^2-(D/2-\delta)^2\}^{1/2} \quad (2)$$

The flatness ratio δ is determined from this formula by assuming, for example, a push load of 10 tf, a core roll diameter of 50 mm, a belt thickness of 10 mm, a belt width of 2,000 mm and a Young's modulus of 0.25 kg/mm$^3$. Next, when this flatness ratio δ is substituted in the formula for determining the nip width, a nip width of 30 mm can be obtained.

In other words, the metal sheet can be machined at a radius of curvature of the metal sheet between the guide belt changed by a predetermined nip width by the radius of curvature of the core roll and the core roll.

On the other hand, the diameter of the push roll is not associated with bending work of the metal sheet but a roll diameter sufficiently greater than that of the core roll is used as a roll diameter having rigidity capable of exhibiting the push load. Therefore, a flat sheet having an infinite radius of curvature can be moved, for example.

Next, manufacture of a pipe when the guide belt is used in the bending roll described above will be explained with reference to FIGS. 5(*a*)–(*c*).

Figure 5:
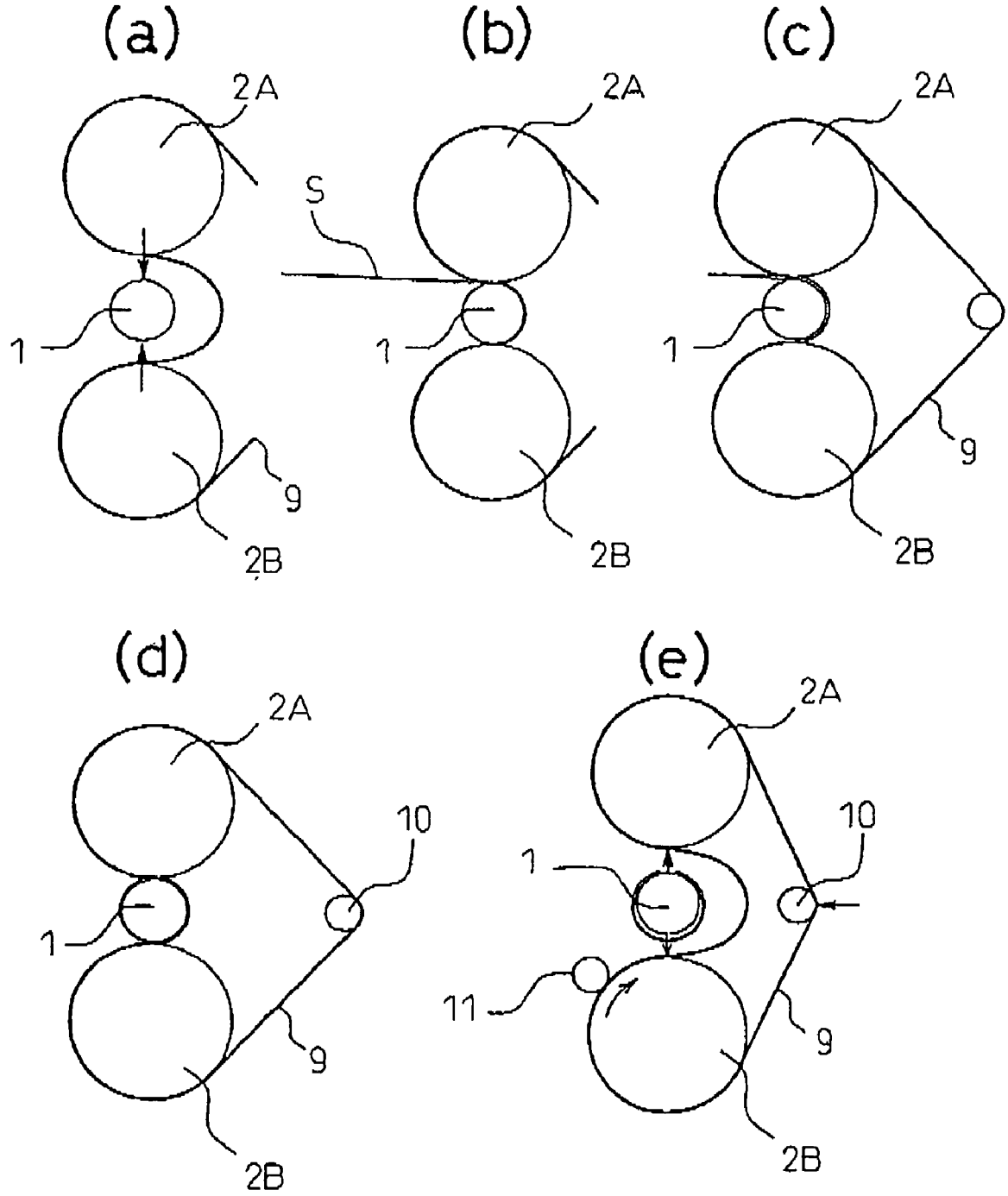
FIGS. 5(*a*)–(*e*) are exemplary operating conditions of the bending roll shown in FIG. 1(*e*)

The first and second push rolls 2A and 2B start moving in the direction indicated by arrows in FIG. 5(*a*) from the standby state from the core roll 1 and then move in such a fashion as to push the core roll 1 (FIG. 5(*b*)). Under this state, the metal sheet S as the pipe material enters from between the core roll 1 and the first push roll and is subjected to roll bending by the core roll and the push roll 2A (FIG. 5(*c*)). Next, when the distal end of the metal sheet S reaches the push roll 2B, the roll bending work is again applied by the core roll 1 and the push roll 2B. After the metal sheet turns about a circumference of the core roll 1, the roll bending work is finished (FIG. 5(*d*)).

The rotation of each roll is thereafter stopped and the push rolls 2A and 2B and the tension roll 10 are moved to loosen the guide belt 9 as shown in FIG. 5(*e*). When the push roll 2A is rotated in the direction of the arrow from the state where the pinch roll 11 is wound on the push roll 2A, the state returns to the initial state shown in FIG. 5(*a*) where the push roll 2A is separated from the core roll 1.

FIGS. 5(*a*)–(*e*) illustrate an exemplary manufacture of the pipe by the method that moves the upper and lower push rolls 2A and 2B relative to the core roll 1 that does not move.

However, it is also possible to keep one of the upper and lower push rolls 2A (or 2B) stationary and to move the core roll 1 and the other push roll 2B (or 2A).

When the guide belt 9 is released as described above, the metal sheet S shaped into the pipe form is taken out from the core roll 1 and the end portions are passed through the welding step, not shown, to complete the product.

Figure 6:
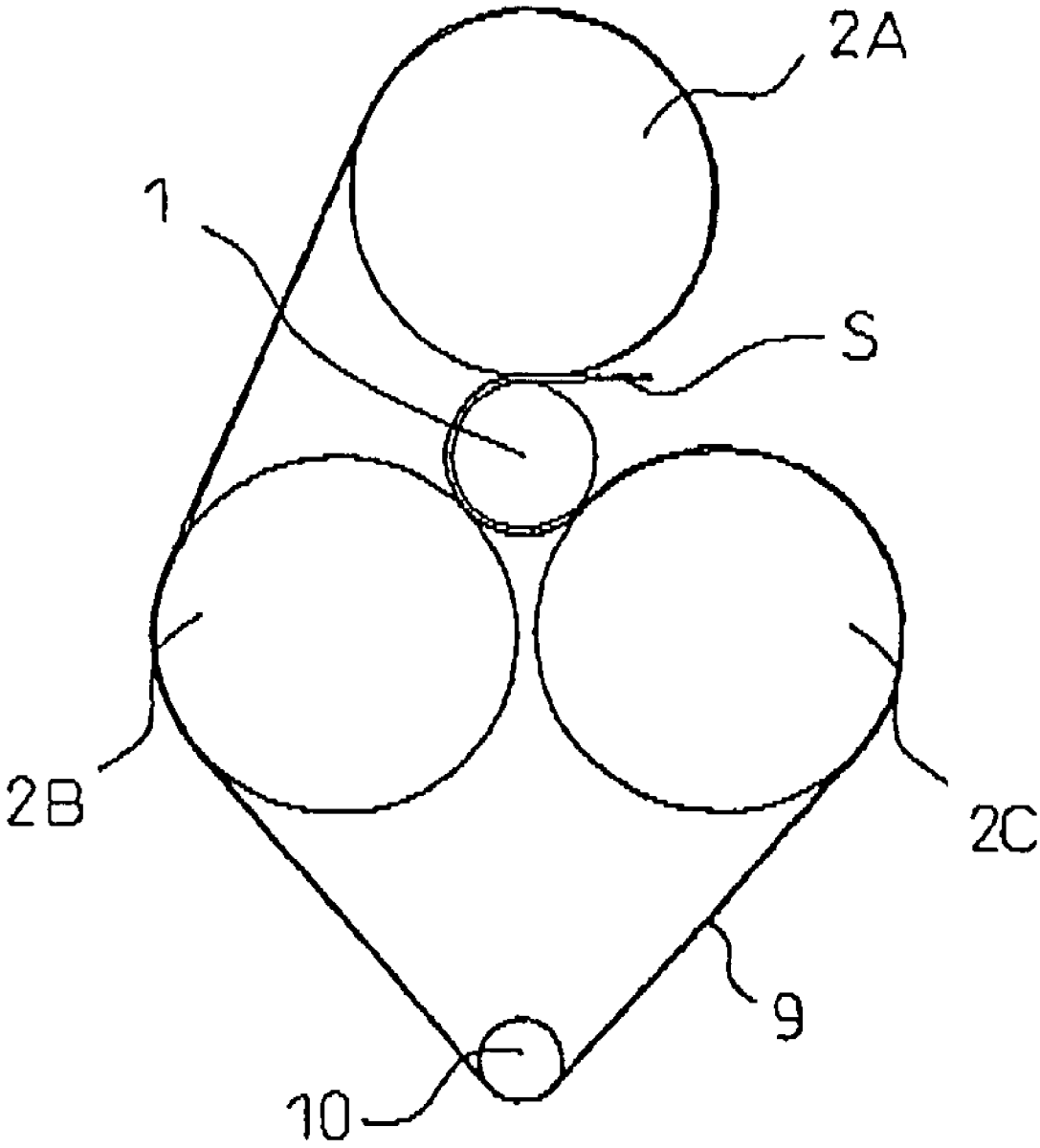
FIG. 6 is a further embodiment of the bending roll according to the present invention where three push rolls are arranged in FIG. 1(*e*)

FIG. 6 shows an example where three push rolls are used, that is, one push roll above the core roll 1 and two push rolls 2 below the core roll.

The example using the three push rolls 2 has the construction in which the distal end of the metal sheet S subjected to the roll bending work by the core roll 1 and the first push roll 2A reaches relatively quickly the next push roll 2B unlike the form shown in FIG. 5 and after the roll bending work is applied by the core roll 1 and the second push roll 2B, the distal end of the metal sheet S reaches the push roll 2C. Therefore, deflection of the core roll 1 hardly develops at the time of winding. Furthermore, because the metal sheet S reaches the next push roll while the distance of the metal sheet S from the core roll 1 is small, the distal end portion of the metal sheet S is not bent or broken and the roll bending work can be carried out smoothly.

Figure 7:
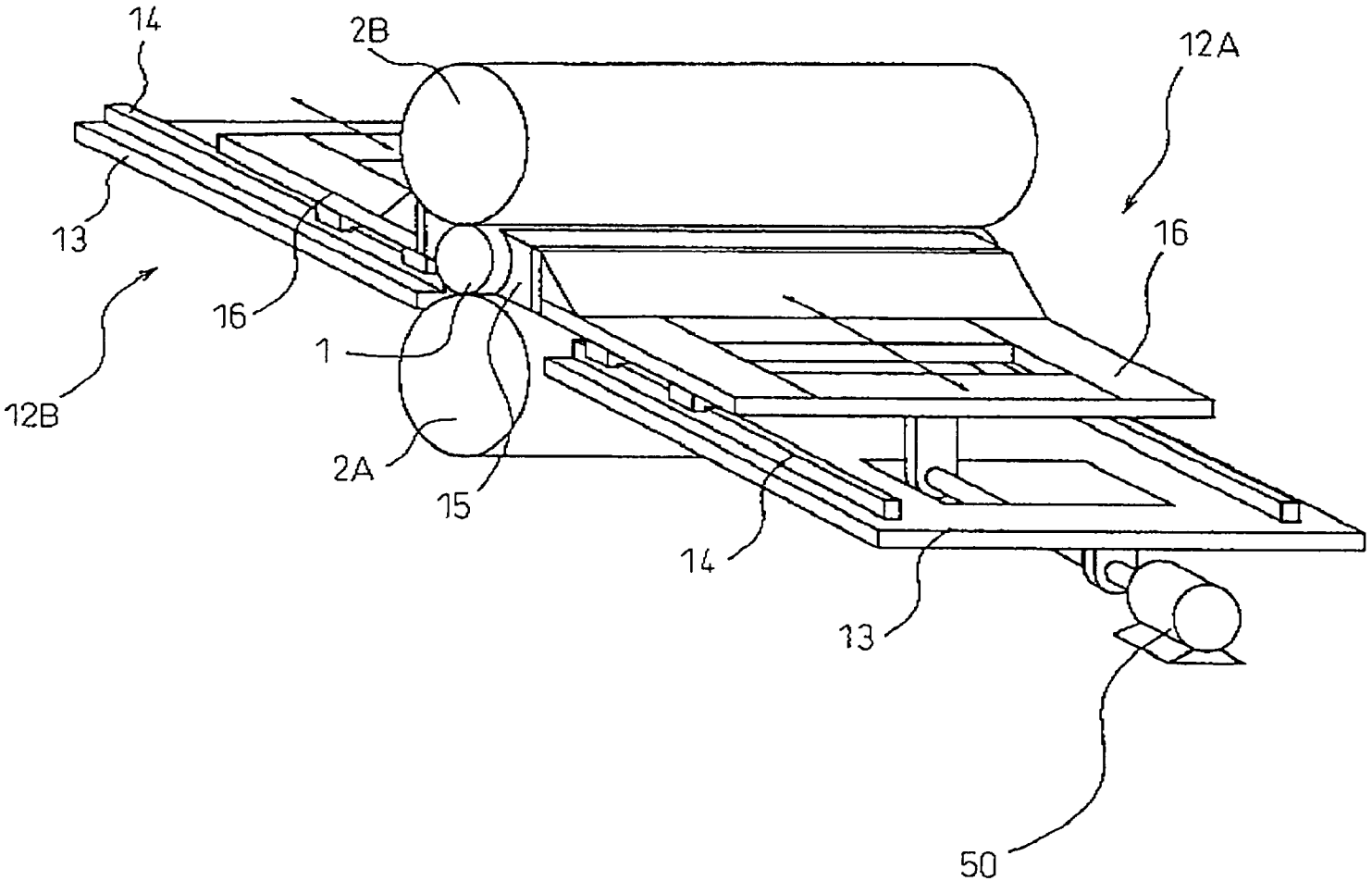
FIG. 7 is yet another exemplary embodiment of the bending roll in which a metal sheet guide device is disposed between two push rolls according to the present invention.
Figure 8:
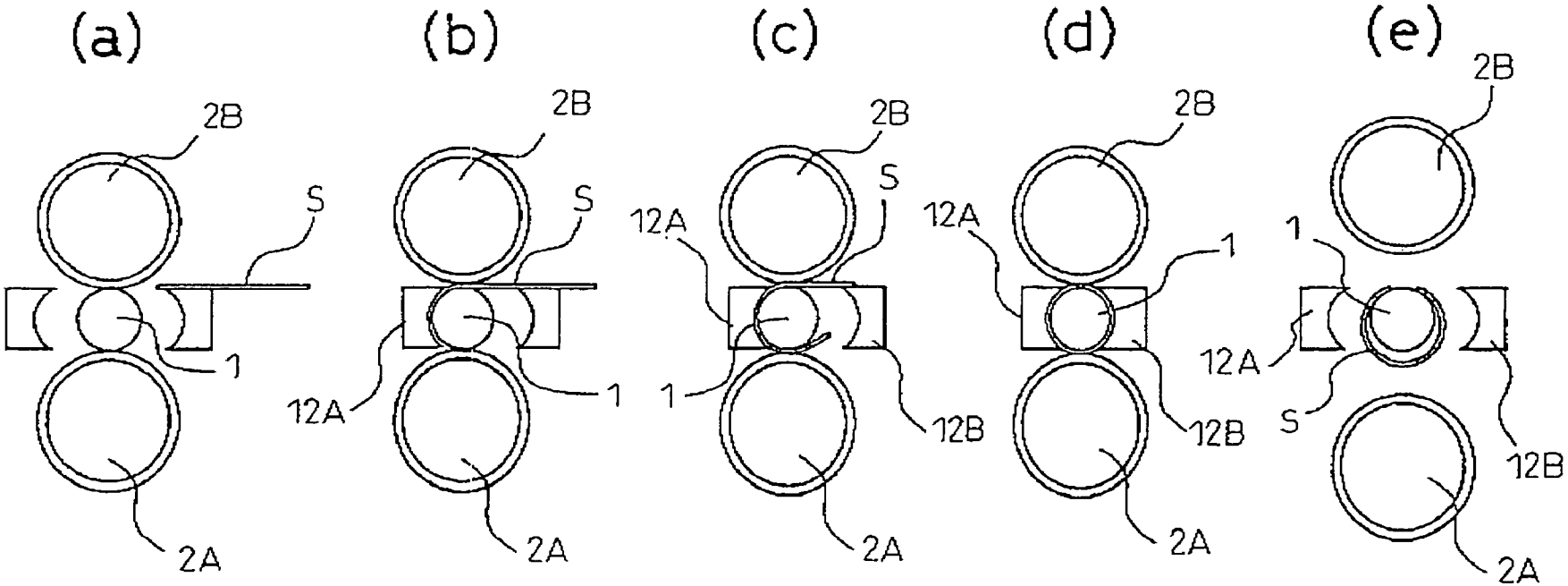
FIG. 8(*a*)–(*e*) are exemplary operating conditions of the bending roll shown in FIG. 7.

FIGS. 7 and 8 show an exemplary embodiment of an apparatus according to the present invention using metal sheet guide devices 12A and 12B.

In this exemplary embodiment, the push rolls 2 are disposed above and below the core roll 1 as the center. A moving mechanism capable of advancing to the position at which a guide member 15 is pushed to the roll surface portion and capable of moving back to the position at which the finished product can be taken out is provided on rails 14 of tables 13 disposed on the right and left of the core roll 1.

A resin material, such as hard nylon, is preferably used for the guide member lest it scratch a counter-part member when the guide member comes into contact with the metal sheet S or the core roll 1.

The moving mechanism uses a known driving power source such as a motor.

In this embodiment, the metal sheet S is fed between the core roll 1 and the push roll 2B (FIG. 8(*a*)) and is rolled and bent between both rolls. The distal end of the metal sheet S is bent while being pushed to the surface of the core roll 1 by the metal guide device 12A. When the distal end of the metal sheet S passes over the push roll 2A, the metal guide device 12B moves forward and pushes the metal sheet S to the surface of the core roll 1 and the metal sheet S is bent (FIG. 8(*c*)). After the bending work is finished, the metal sheet guide devices 12A and 12B move back from the core roll 1 and the cylindrical metal sheet after the bending work can be removed from the core roll (see FIGS. 8(*d*) and (*e*)).

Whenever the distal end of the metal sheet passes between the support rolls, the guide plate between the rolls moves and pushes the metal sheet, thereby conducting the bending work. The distal end of the metal sheet is pushed by the guide member and comes into close contact with the core roll. Therefore, insertion of the metal sheet into the next support rolls can be made without excessive deformation and the bending work can be carried out reliably.

Figure 9:
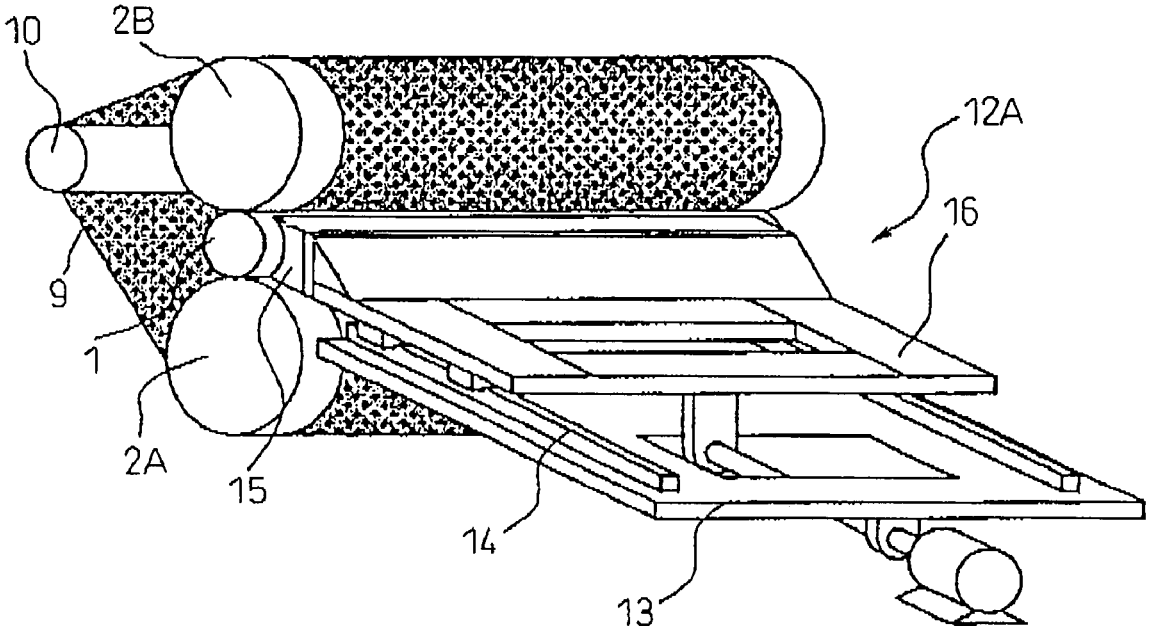
FIG. 9 is still another exemplary embodiment of the bending roll, in which a guide belt is disposed between two push rolls according to the present invention and a metal sheet guide device is used for the bending roll.
Figure 10:
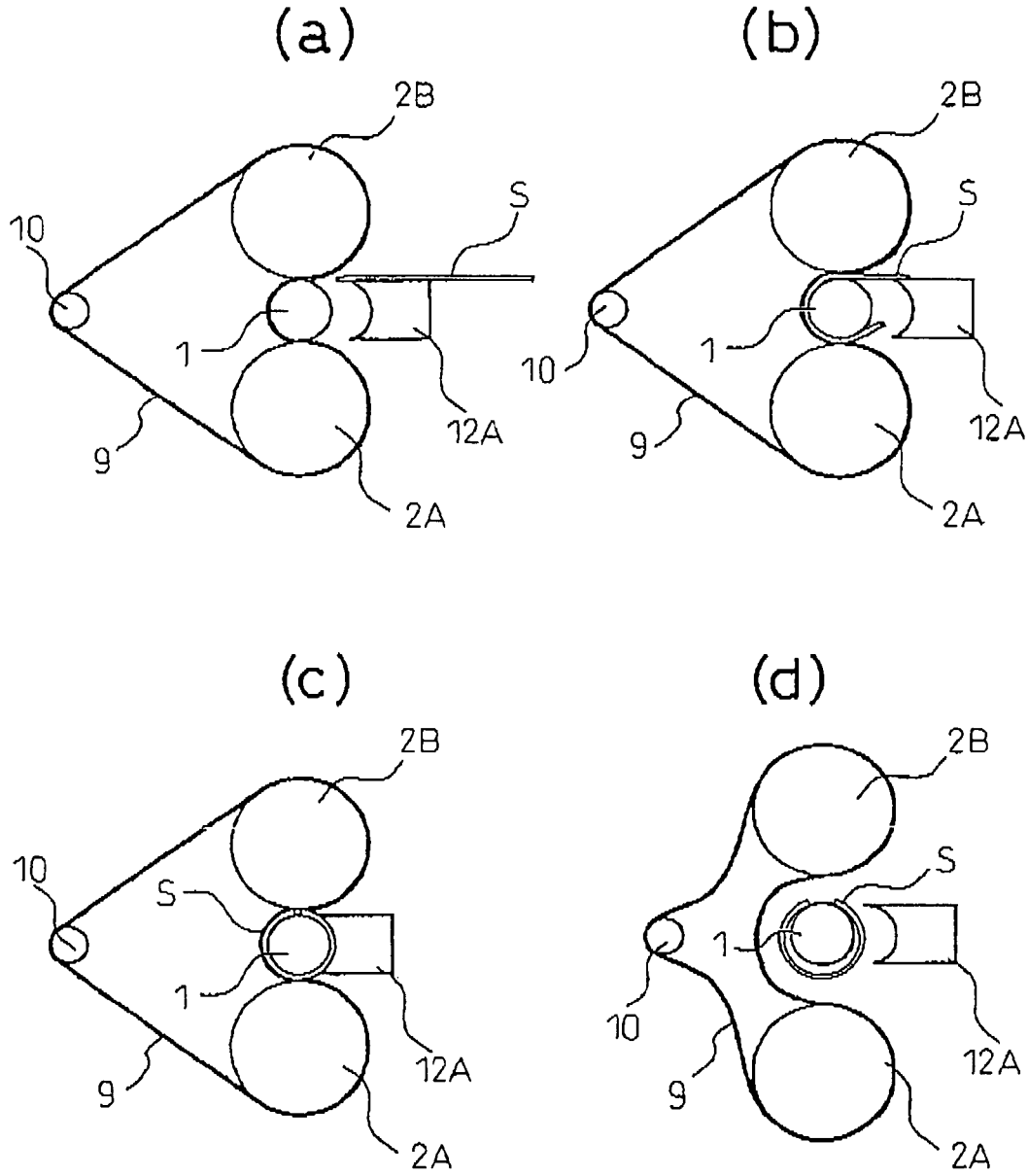
FIG. 10(*a*)–(*d*) are operating conditions of the bending roll shown in FIG. 9.

FIGS. 9 and 10(*a*)–(*d*) show an exemplary embodiment and exemplary operation of the present invention that uses the guide belt 9.

The push rolls 2 are arranged above and below the core 1 as the center and the guide belt 9 driven in synchronism with the rotating speed of the core roll 1 is interposed between the contact portions of the core roll 1 and the upper and lower push rolls 2.

The metal sheet S is rolled and bent by the core roll 1 and the push roll 2A. The distal end of the metal sheet S is thereafter inserted between the guide belt 9 and the core roll 1. As the guide belt 9 is driven in synchronism with the rotating speed of the core roll 1, the distal end of the metal sheet S is delivered to the push roll 2B with the rotation of the core roll 1 and smooth roll bending work is carried out.

The installation position of the guide belt is not particularly limited. However, because the speed at the roll center portion drops when the roll undergoes the barrel-like deformation, it is preferred to arrange the guide belt at least in the roll center portion and in a width covering the full width of the metal sheet.

Figure 11:
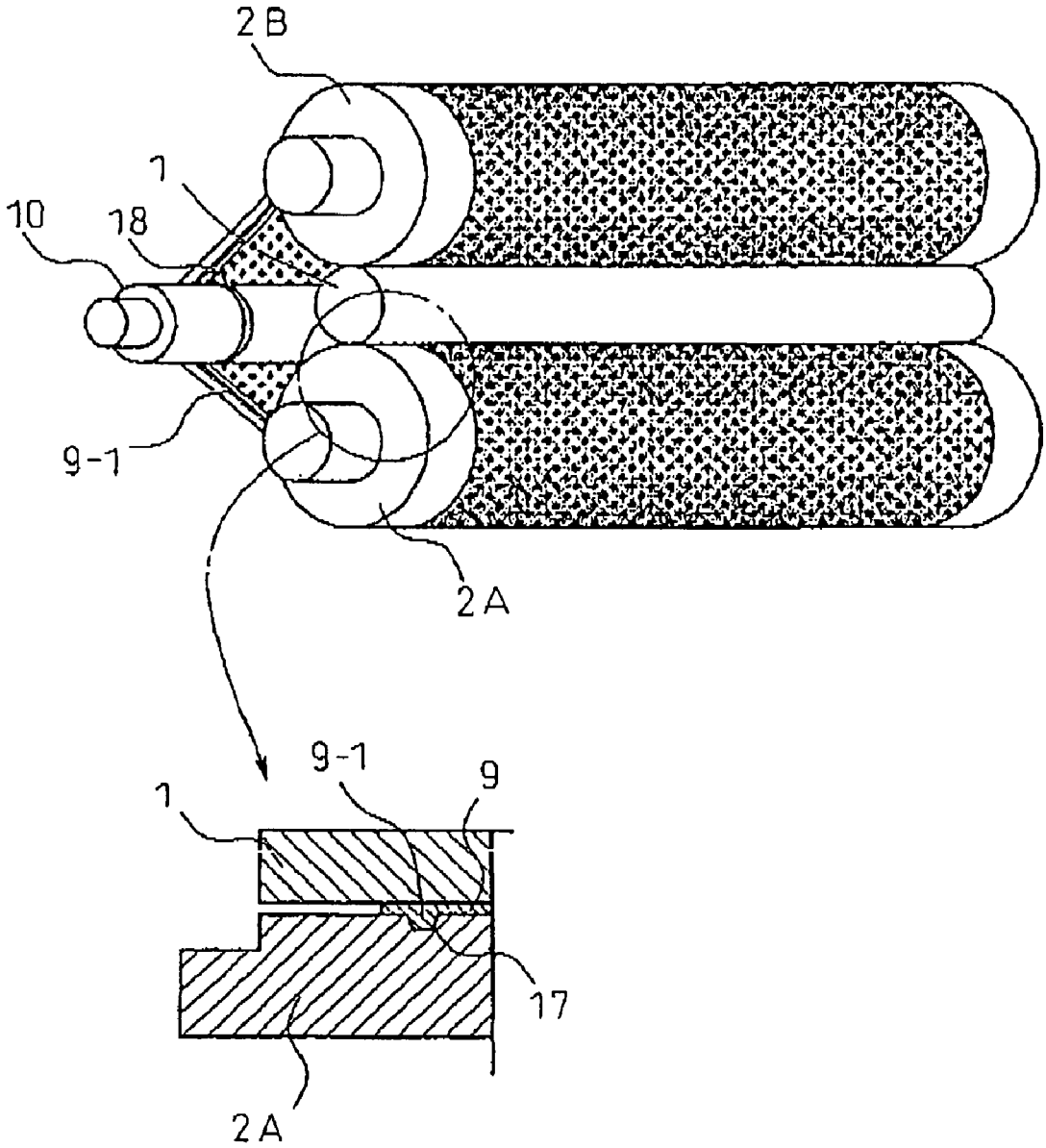
FIG. 11 is a perspective view of an exemplary embodiment of the bending roll, in which a guide band is provided to the guide belt as shown in FIGS. 10(*a*)–(*d*)

An exemplary embodiment shown in FIG. 11 has a construction in which a guide band is provided to the guide belt 9.

In other words, a convex guide band 9-1 is disposed on the push roll side surface of the guide belt 9. Grooves 17 into which the guide band 9-1 is inserted are formed in the push rolls 2A and 2B. A similar groove 18 is also formed in the tension roll 10.

The guide band 9-1 is fitted into the grooves 17 of the push rolls 2A and 2B and can prevent a zigzag movement and creasing of the wide belt during its operation. As the metal sheet wound on the core roll does not undergo friction and excessive deformation, the shaping accuracy of the cylindrical shape can be improved.

Figure 12:
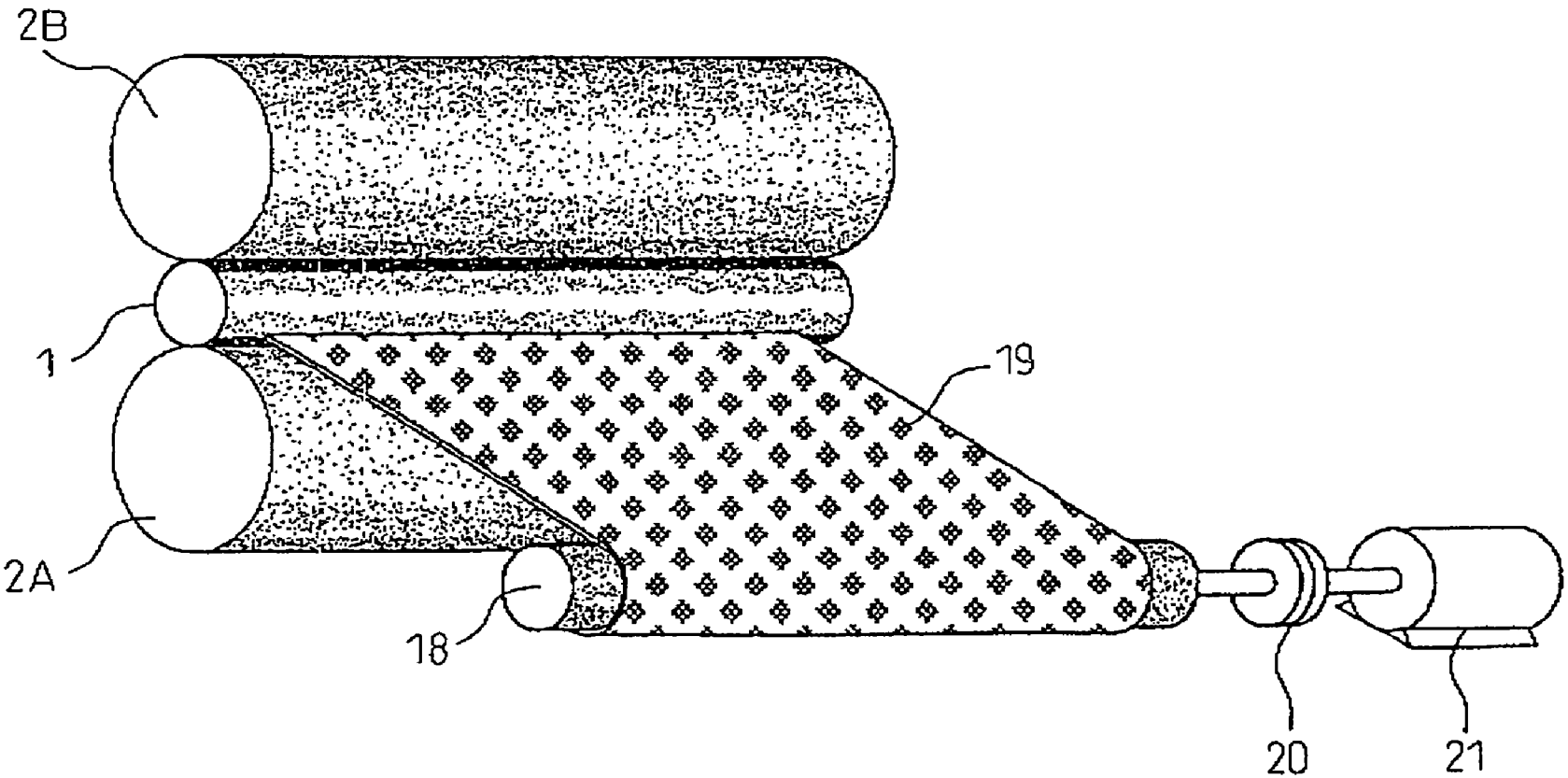
FIG. 12 is another exemplary embodiment of the bending roll in which a winding belt according to the present invention is used while being wound on the core roll.

FIG. 12 shows an exemplary embodiment of the apparatus, in which the winding belt is used while being wound on the core roll. In other words, push rolls 2A and 2B, each having a plurality of surface elastic members that come into contact with the core roll 1 formed of a metal from above and below, are disposed. One of the ends of the winding belt 19 is bonded and fixed to the core roll 1 and the other end is fixed to the tension roll 18. The winding belt 19 is fixed by inserting its distal end into a slit formed in the core roll 1 and bonding it with an adhesive, for example.

Preferably, the tension roll 18 employs a system in which the tension roller 18 and a winding/rewinding direction driving mechanism 21 interpose between them a torque limiter 20 that interconnects to a brake for imparting a predetermined tension in the winding direction at the time of winding and rewinding.

Figure 13:
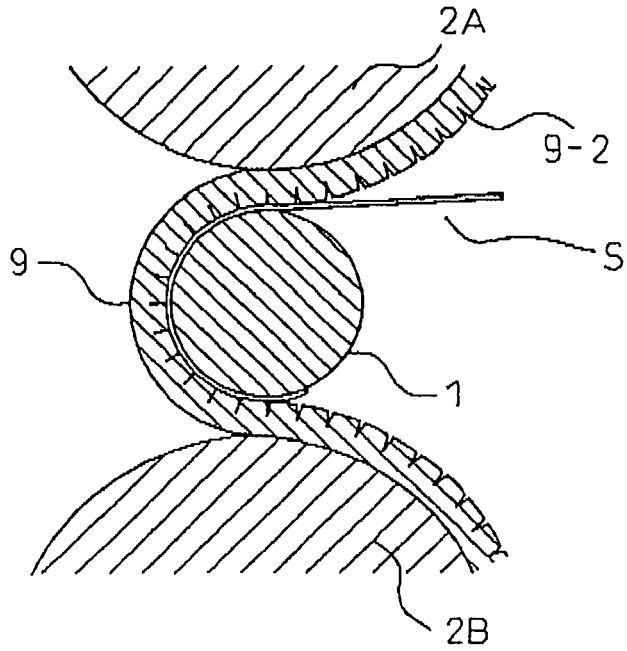
FIG. 13 is a partial enlarged view showing an embodiment of the bending roll, in which slits are formed in the guide belt according to the present invention.

An exemplary embodiment shown in FIG. 13 illustrates a structural example where slits 9-2 are formed in the guide belt 9 on the side coming into contact with the surface of the core roll 1 in the longitudinal direction of the core roll 1 and these slits reduce the bending radius of the guide belt.

As can be understood from the formula (1) provided above, because a thick belt has a large flatness ratio, the pushing force of the push rolls 2A and 2B can be effectively utilized for the deformation of the metal sheet, but it is difficult to bend the belt itself.

Therefore, a plurality of slits 9-2 is formed on the guide belt 9 on the contact side with the surface of the core roll 1 in the longitudinal direction of the core roll 1 as described above. Because of these slits, the length of the circumferential surface on the side of the core roll 1 becomes shorter than the length on the outer side of the guide belt 9, and the guide belt can be easily bent along the outer circumferential surface of the core roll 1. When the metal sheet is machined into a metal cylinder having a small diameter, the pushing force of the push rolls 2A and 2B can be effectively utilized.

Figure 14:
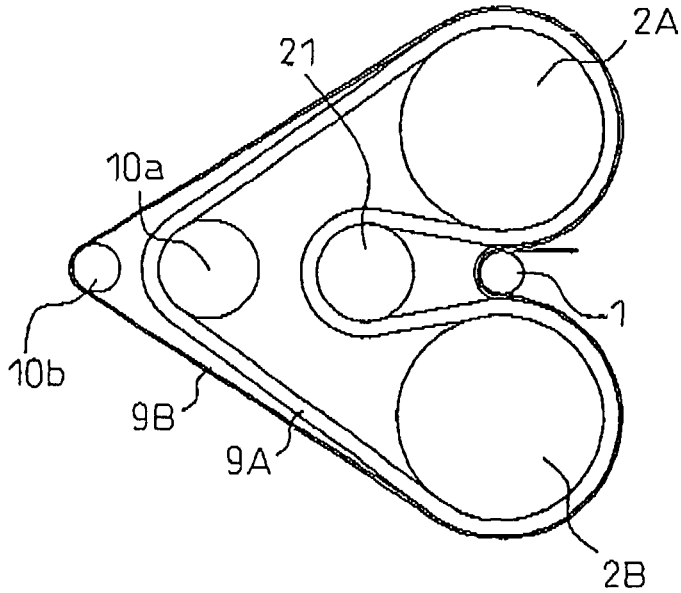
FIG. 14 another exemplary embodiment of the bending roll in which two belts, that is, the bending belt and the thin guide belt according to the present invention, are used.

FIG. 14 shows another exemplary construction when the guide belt 9 is similarly used. The elastic guide belt is not wound on the core roll having a small diameter but is used as a bending belt 9A that is used only for machining the metal sheet S. The metal sheet passes between this bending belt 9 and the core roll 1, and a thin guide belt 9B formed of a cloth, or the like, driven in synchronism with the core roll and capable of easy bending deformation is interposed. In this embodiment, the bending belt performs the bending work and the thin guide belt 9B prevents spring-back of the metal sheet and performs the bending work of a small diameter. In the drawing, reference numerals 10*a* and 10*b* denote tension rolls and reference numeral 21 denotes a pinch roll.

Figure 15:
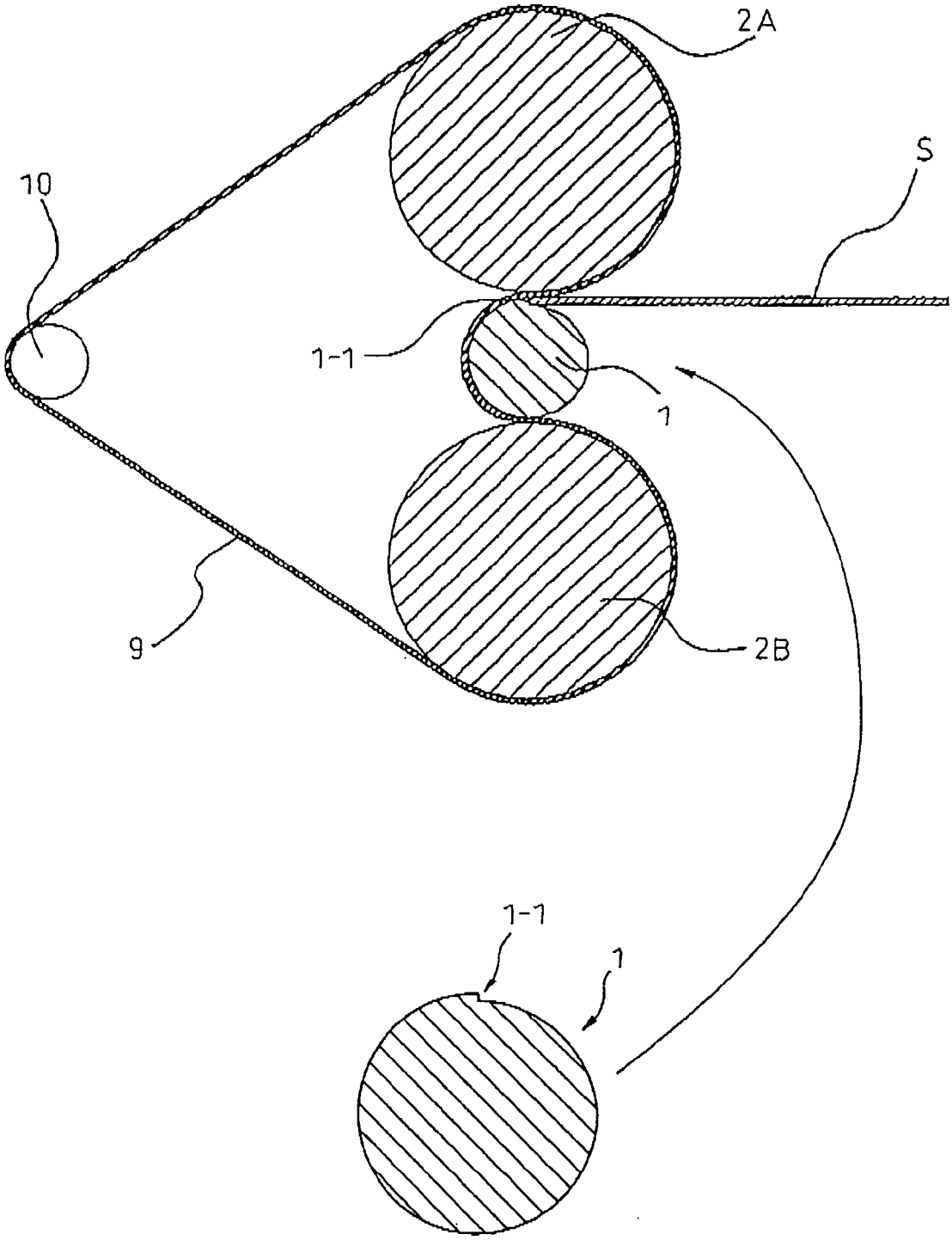
FIG. 15 is a side view showing another embodiment of a bending roll, having two push rolls according to the present invention, in which a step is applied to a core roll surface.

FIG. 15 is a schematic view of another exemplary embodiment, in which two push rolls are disposed. The bending roll in this embodiment includes the core roll 1 for feeding the metal sheet S and operating as the center of the bending work, two push rolls 2A and 2B disposed above and below the core roll 1, and the guide belt 9 of an elastic material body interposed between the core roll 1 and the upper and lower push rolls 2A and capable of moving in synchronism with the push rolls 2A.

The shape of the core roll 1 is shown in a lower portion of FIG. 15. A step 1—1 corresponding to the thickness of the metal sheet to be machined is disposed at one position of the outer circumference and the roll radius is gradually changed in the step.

Next, manufacture of a pipe, using the bending roll described above, is explained with reference to FIG. 15.

The metal sheet S is inserted while the first and second push rolls 2A and 2B are pushed to the core roll 1 in such a fashion that the distal end of the metal sheet S is positioned to the step 1—1. Next, the core roll 1 and the push rolls 2A and 2B are rotated. At this time, the metal sheet S is bent by the first push roll 2A while being held by the guide belt 9. When the bending work is further continued from this state, the distal end of the metal sheet 6 reaches the surface of the core roll 1 at which it is not held by the guide belt and, then, leaves the surface of the core roll 1 due to spring-back. A metal sheet guide device 12A disposed separately is moved forward in the direction indicated by an arrow and, while the distal end of the metal sheet S is pushed to the core roll 1, the bending work is continued. When the core roll 1 substantially rotates once, the distal end of the metal sheet S reaches the position of the push roll 2A. At this time, the distal end portion of the metal sheet S is inserted into the portion of the step 1—1 of the core roll 1 and the depth of the step is equal to the thickness of the metal sheet S. Therefore, the upper end surface of the core roll 1 and the upper surface of the distal end of the metal sheet S exist on substantially the same curve surface, and bending work is performed while the rear end portion of the metal sheet S is smoothly wound double. When the bending work is done up to the rear end portion of the metal sheet, the bending work is finished. Thereafter the rotation of each roll is stopped and the push rolls 2A and 2B and the tension roll 10 are moved to loosen the guide belt 9.

Figure 16:
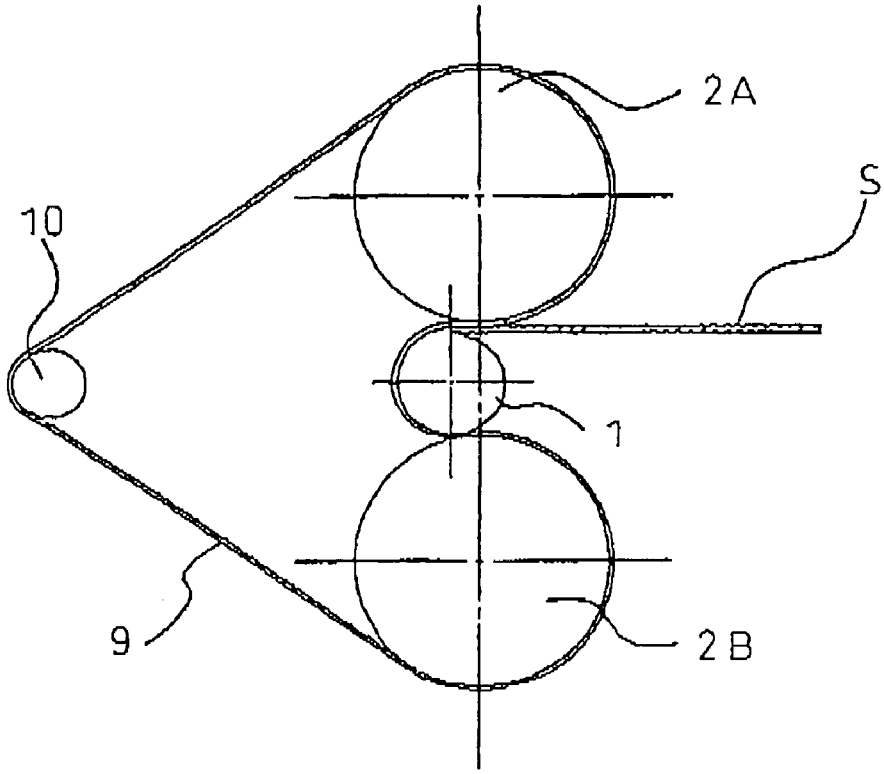
FIG. 16 is an embodiment of a bending roll having two push rolls according to the present invention, in which the center of the core roll is offset to the side on which the guide belt is wound.
Figure 17:
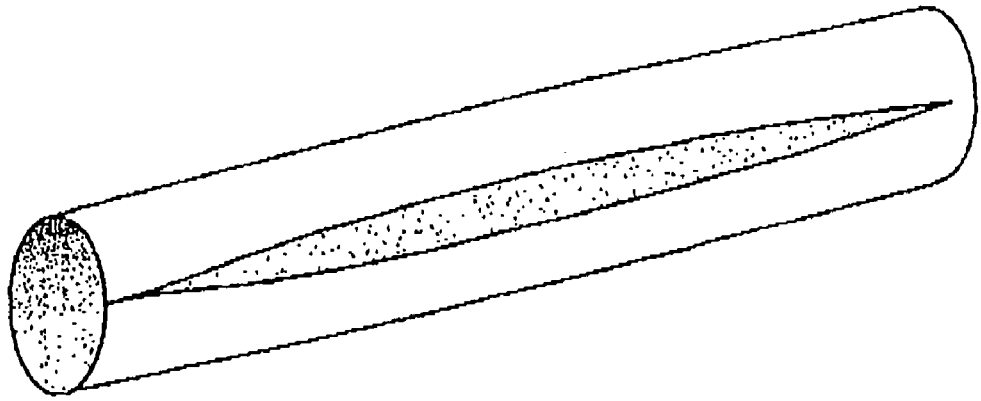
FIG. 17 is a perspective view of a barrel-shaped pipe shaped by a conventional roll bending work.

An exemplary embodiment shown in FIG. 16 illustrates the case in which the center of the core roll 1 is offset towards the winding side of the guide belt 4 with respect to the straight line connecting the centers of the push rolls 2A and 2B. Due to this offset, this embodiment can impart the component of force of the push force in the horizontal direction as the reaction to the belt tension during machining and can therefore suppress deflection of the core roll 1 in the horizontal direction.

EXAMPLE 1

In the exemplary apparatus of the embodiment shown in FIGS. 1(*a*) to 3, the diameter of the core roll 1 is 50 mm, the diameter of the push roll 2 is 400 mm, the thickness of the elastic material member portion of the urethane rubber is 50 mm, and the metal sheet 6 used is a steel sheet having a thickness of 0.5 mm and a length of 2 m. Under this condition, the roll bending work is carried out at 500 mm/min and a pushing force about 10 tf, of the push roll 2.

After the bending work, the metal sheet 6 can be shaped in such a fashion that its end portions exist almost on the straight line, a gap at the center hardly exists and the pipe does not become barrel-like.

EXAMPLE 2

In the apparatus of the exemplary embodiment shown in FIGS. 1(*a*)–(*e*), 5(*a*)–(*e*) and 6, the diameter of the core roll 1 is 85 mm, the diameter of the push roll 2 is 400 mm, the thickness of the guide belt of the elastic material member is 10 mm, and the metal sheet 6 used is a soft steel sheet having a thickness of 0.8 mm, a width of 267 mm and a length of 2 m. Under this condition, the roll bending work is carried out at a core roll speed of 540 mm/min and a pushing force about 10 tf of the push roll 2.

After the bending work, the metal sheet 6 has an outer diameter $\phi$ of about 115 mm, and can be shaped in such a fashion that its end portions are substantially parallel, and the pipe does not become barrel-like.

EXAMPLE 3

In the apparatus of the exemplary embodiment shown in FIG. 15, the core roll 1 has a diameter of 60 mm, the height of the step 10 is 1.0 mm, the diameter of the push roll 2A is 400 mm, the thickness of the guide belt of the elastic material member is 5 mm, and the metal sheet 6 used is a high tensile steel having a tensile stress of 600 N/mm$^2$, a thickness of 1.0 mm and a length of 2 m. Under this condition, the roll bending work is carried out at a core roll speed of 540 mm/min and a pushing force about 10 tf, of the push roll 2A.

After the bending work, the metal sheet 6 has an outer diameter of about 76 mm and can be shaped in such a fashion that its end portions exist substantially on a straight line with the spring-back amount substantially coincident with the calculation value, the gap at the center hardly exists and the pipe does not become barrel-like.

INDUSTRIAL APPLICABILITY

The bending roll apparatus according to the invention can stably manufacture a small diameter elongated pipe the shaping of which has not been possible in the past.

Because the exemplary embodiments of the present invention can prevent, in advance, deflection of the core roll, it can prevent, in advance, a so-called "barrel-like deformation" of the product and can shape a small diameter elongated pipe.

Because the metal sheet itself is wound and adhered on the core roll, the metal sheet can be machined at a constant radius of curvature from its leading edge to the trailing edge and a pipe having excellent finish can be manufactured.

Furthermore, small diameter machining can be made even by using a relatively hard elastic material belt.

The invention claimed is:

1. A bending roll apparatus for manufacturing a pipe, comprising:

(a) a core roll formed from a metal having an elongated circumference surface;

(b) a plurality of push rolls formed of an elastic material disposed around the core roll to hold the core roll by holding the core roll at a plurality of positions of the elongated circumference surface of the core roll and to form a contact portion;

(c) a tension roll disposed for tensioning a guide belt;

(d) said guide belt having an inner surface and an outer surface and possessing elasticity, wherein said guide belt is continuous and is wound on the push rolls and on the tension roll by said inner surface and on the core roll by said outer surface such that at least a portion of the elongated circumference surface that is on a side opposite to the tension roll is not wound over by said guide belt, wherein said guide belt is synchronously driven with the core roll, and wherein a metal sheet can be fed into the contact portion and bent around the core roll to form a shape of pipe.

2. The bending roll apparatus according to claim 1, wherein the guide belt meshes with the surface of the core roll, and has slits for reducing a bending radius in a longitudinal direction of the core roll.

3. The bending roll apparatus according to claim 1 or 2, further comprising a guide band and a groove, wherein the guide band is disposed on the guide belt, and the groove is formed on one or more of the push rolls where the guide band fits into the groove so that the guide band guides the guide belt as the guide band passing through the groove.

4. The bending roll apparatus according to claim 1 or 2, wherein the core roll has a step having a depth that may be adjusted to be substantially the same as the thickness of a metal sheet being bent by the apparatus.

5. The bending roll apparatus according to claim 1 or 2, wherein the push rolls are so arranged to oppose one another while interposing the core roll, and the center of the core roll is arranged to be offset toward the tension roll from the line connecting the centers of said opposite push rolls.

6. The bending roll apparatus according to claim 1, wherein the plurality of the push rolls is three.

7. The bending roll apparatus according to claim 6, wherein the push rolls comprises a top push roll and a bottom push roll, and the center of the core roll is so arranged as to be offset toward the tension roll from a line connecting the centers of the top and bottom push rolls.

8. The bending roll apparatus according to claim 6, wherein the core roll has a step having a depth that may be adjusted to be substantially the same as the thickness of a metal sheet being bent by the apparatus.

9. A bending roll apparatus for manufacturing a pipe, comprising:

(a) a core roll formed from a metal having an elongated circumference surface;

(b) a plurality of push rolls formed of an elastic material disposed around the core roll to hold the core roll by holding the core roll at a plurality of positions of the elongated circumference surface of the core roll and to form a contact portion;

(c) a plurality of tension rolls disposed for tensioning a guide belt;

(d) a bending belt having an inner surface and an outer surface and possessing elasticity, where said bending belt is continuous and is wound on the push rolls and on at least one of the tension rolls by said inner surface and around the core roll by said outer surface such that at least a portion of the elongated circumference surface that is on a side opposite to the tension roll is not wound over by said bending belt and said guide belt; and (e) said guide belt passing between the core roll and the bending belt and being synchronously driven with the core roll, wherein a metal sheet can be fed into the contact portion and bent around the core roll to form a shape of pipe.

10. The bending roll apparatus according to claim 9, wherein said tension rolls has first and second tension rolls and said bending roll apparatus further comprises a pinch roll disposed between the first tension roll and the core roll, where the bending belt is wound around on the first tension roll and the push rolls by the inner surface and on pinch roll by the outer surface, and the thin guide belt is wound around on the second tension roll, the push rolls, and the core roll.

11. The bending roll apparatus according to claim 9 or 10, wherein the bending belt meshes with the surface of the core roll, and the outer surface of the bending belt has slits for reducing a bending radius in a longitudinal direction of the core roll.

* * * * *